US010563650B2

(12) United States Patent
Kato et al.

(10) Patent No.: US 10,563,650 B2
(45) Date of Patent: Feb. 18, 2020

(54) COMPRESSOR

(71) Applicant: Hitachi Industrial Equipment Systems Co., Ltd., Chiyoda-ku, Tokyo (JP)

(72) Inventors: Fuminori Kato, Tokyo (JP); Yoshiyuki Kanemoto, Tokyo (JP); Shumpei Yamazaki, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 485 days.

(21) Appl. No.: 15/509,907

(22) PCT Filed: Nov. 27, 2014

(86) PCT No.: PCT/JP2014/081460
§ 371 (c)(1),
(2) Date: Mar. 9, 2017

(87) PCT Pub. No.: WO2016/084207
PCT Pub. Date: Jun. 2, 2016

(65) Prior Publication Data

US 2017/0298926 A1 Oct. 19, 2017

(51) Int. Cl.
*F04B 49/06* (2006.01)
*F04B 49/10* (2006.01)
(Continued)

(52) U.S. Cl.
CPC ..... *F04B 49/065* (2013.01); *F02D 35/0007* (2013.01); *F02D 35/026* (2013.01);
(Continued)

(58) Field of Classification Search
CPC ..... F04B 49/065
See application file for complete search history.

(56) References Cited

U.S. PATENT DOCUMENTS

2010/0052893 A1 3/2010 Teramoto
2012/0143379 A1 6/2012 Teramoto
2013/0272840 A1* 10/2013 Fujioka ..... F04D 27/00 415/1

FOREIGN PATENT DOCUMENTS

JP 5-157055 A 6/1993
JP 2000-34983 A 2/2000
(Continued)

OTHER PUBLICATIONS

Japanese-language Office Action issued in counterpart Japanese Application No. 2018-041846 dated Feb. 5, 2019 with English translation (nine (9) pages).
(Continued)

*Primary Examiner* — Manuel A Rivera Vargas
(74) *Attorney, Agent, or Firm* — Crowell & Moring LLP

(57) ABSTRACT

Provided is a compressor capable of calculating the correct time remaining before maintenance. The compressor is provided with: a compressor body that compresses fluid; a motor that drives the compressor body; a temperature sensor that detects the temperature of the compressor; a pressure sensor that detects the pressure of the compressed fluid outputted from the compressor body; and a calculation unit that calculates the time remaining before maintenance for the compressor body, using the temperature of the compressor and the pressure of the compressed fluid assigned with respective predetermined weights. The calculation unit changes the weighting of the temperature according to the pressure of the compressed fluid or the operation rate of the compressor body.

13 Claims, 4 Drawing Sheets

(51) Int. Cl.

| | |
|---|---|
| ***F02D 35/00*** | (2006.01) |
| ***F02D 35/02*** | (2006.01) |
| ***F02D 41/14*** | (2006.01) |

(52) U.S. Cl.

CPC ..... *F02D 41/145* (2013.01); *F04B 49/10* (2013.01); *F04B 2201/0801* (2013.01); *F04B 2203/0209* (2013.01); *F04B 2205/04* (2013.01); *F04B 2205/05* (2013.01); *F04B 2207/03* (2013.01); *F04B 2207/70* (2013.01)

(56) References Cited

FOREIGN PATENT DOCUMENTS

| | | | |
|---|---|---|---|
| JP | 2006-97655 | A | 4/2006 |
| JP | 2010-53791 | A | 3/2010 |
| JP | 2013-209902 | | 10/2013 |

OTHER PUBLICATIONS

English translation of document B1 (JP 2006-97655 A previously filed on Mar. 9, 2017) (38 pages).

English translation of document B2 (JP 5-157055 A previously filed on Mar. 9, 2017) (34 pages).

English translation of document B4 (JP 2000-34983 A previously filed on Aug. 10, 2018) (18 pages).

Extended European Search Report issued in counterpart European Application No. 14906751.4 dated May 30, 2018 with English translation (eight (8) pages).

International Search Report (PCT/ISA/210) issued in PCT Application No. PCT/JP2014/081460 dated Mar. 3, 2015 with English translation (3 pages).

Japanese-language Written Opinion (PCT/ISA/237) issued in PCT Application No. PCT/JP2014/081460 dated Mar. 3, 2015 (4 pages).

* cited by examiner

COMPRESSOR

TECHNICAL FIELD

The present invention relates to a compressor which compresses fluid such as air with a motor as a power source.

BACKGROUND ART

In a compressor such as a scroll compressor, it is necessary to inspect constituent parts such as a bearing and change grease, sealing and the like at a certain interval of predetermined operating time. In conventional products, maintenance is conducted at an interval of predetermined operating time or predetermined operating period in correspondence with pressure specification. The life of the grease, bearing or the like changes in correspondence with pressure or temperature upon actual operation of the compressor.

As a conventional technique to change maintenance time in consideration of pressure and ambient temperature and notify inspection time, Patent Literature 1 discloses a "compressor comprising: a motor; a compressor unit, driven with the motor, that discharges compressed gas; driving time integration means for integrating driving time of the compressor; and inspection time notification means for notifying inspection time of the compressor unit using the driving time integrated by the driving time integration unit, wherein the inspection time notification means is formed with integrated driving time correction means for correcting the driving time integrated by the driving time integration means in correspondence with operating conditions of the compressor unit, and notification signal output means for outputting a notification signal to notify of the inspection time when the integrated driving time corrected by the integrated driving time correction means reaches predetermined inspection time. The compressor unit stops when pressure in a tank storing the compressed gas becomes higher than upper limit pressure while the compressor unit is driven when the pressure becomes lower than lower limit pressure, and the upper limit pressure is variably set, and wherein, when the upper limit pressure is set to higher pressure in comparison with predetermined upper limit pressure, the integrated driving time correction means performs correction to extend the driving time integrated by the driving time integration means in correspondence with the upper limit pressure." (Claims 1 and 4).

CITATION LIST

Patent Literature

Patent Literature 1: Japanese Unexamined Patent Application Publication No. 2006-97655

SUMMARY OF INVENTION

Technical Problem

In the present products, maintenance time is set in correspondence with pressure specification of the product. In this method, the maintenance time is not changed in correspondence with actual use status (pressure, temperature and the like) of the compressor. It is necessary to set enough time as the maintenance time. The maintenance time is shorter in comparison with the operable period.

In the invention described in Patent Literature 1, corrected integrated driving time is calculated in consideration of the upper limit pressure in the tank and ambient temperature. When the corrected integrated driving time exceeds a set value, maintenance time is notified. However, the internal temperature of the compressor main body changes in accordance with pressure. For example, when the pressure rises, the internal temperature rises. It is the internal temperature that influences constituent parts of the compressor main body. Accordingly, even when the ambient temperature is detected, it is different from the actual internal temperature. It is difficult to accurately calculate the maintenance time.

The present invention has an object to solve these problems and provide a compressor capable of calculating accurate maintenance time.

Solution to Problems

To solve the above problems, the configuration described in the claims is adopted. The present application includes plural means for solving the above problems. As an example of the compressor according to the present invention, there is provided a compressor comprising: a compressor main body that compresses fluid; a motor that drives the compressor main body; a temperature sensor that detects temperature of the compressor; a pressure sensor that detects pressure of compressed fluid outputted from the compressor main body; and a calculation unit that calculates a maintenance cycle of the compressor main body using the temperature of the compressor and the pressure of the compressed fluid with respective weights.

In the compressor according to the present invention, it is preferable that the calculation unit changes weighting of the temperature in correspondence with pressure of the compressed fluid.

Further, in the compressor according to the present invention, it is preferable that the calculation unit changes the weighting of the temperature in correspondence with operating rate of the compressor main body.

Advantageous Effects of Invention

According to the present invention, it is possible to obtain accurate maintenance time in consideration of internal temperature of a compressor main body. Since the maintenance time is shortened when the compressor is used under a high load condition, it is possible to infallibly prevent failure. Further, since the maintenance time is extended when the compressor is used under a low load condition, the period before maintenance implementation is extended and customer benefits are provided.

DESCRIPTION OF EMBODIMENTS

Figure 1:
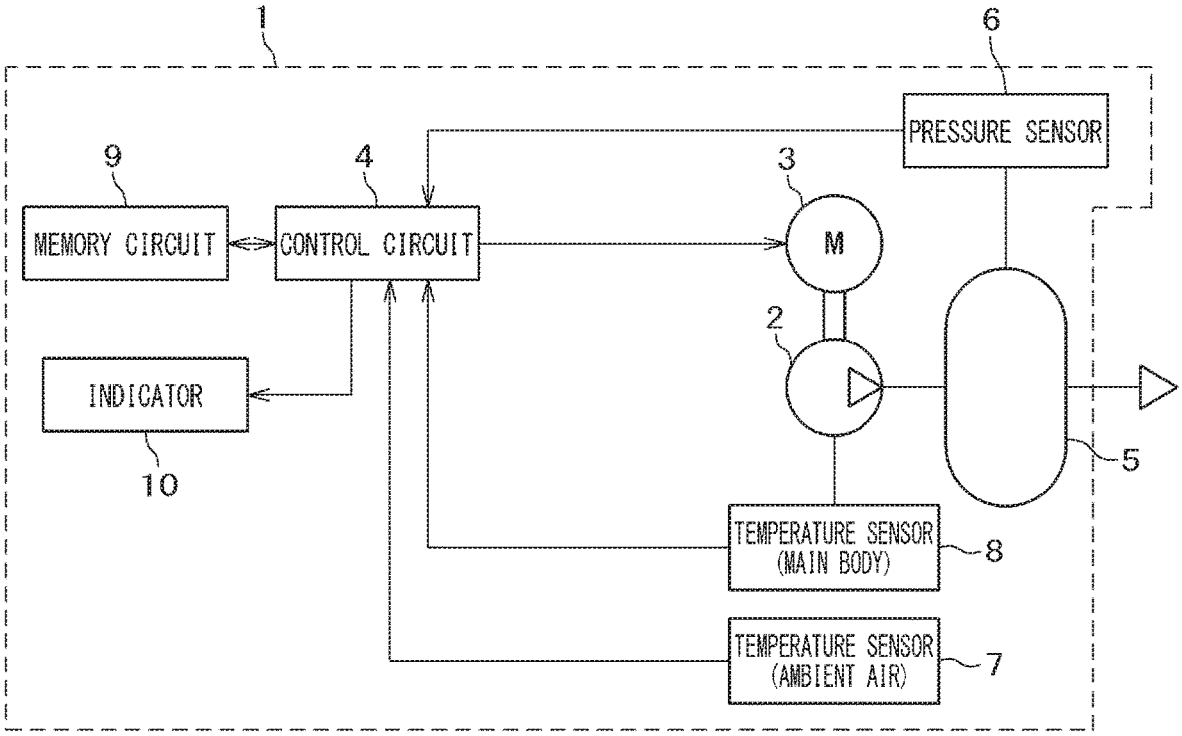
FIG. 1 is a block diagram of a compressor according to a first embodiment of the present invention.

Hereinbelow, embodiments of the present invention will be described using the drawings. Note that in the respective figures for explanation of the embodiments, elements having the same function have the same name and reference numeral, and the repeated explanations will be omitted.

First Embodiment

A system according to the present embodiment will be described using FIGS. 1, 2 and 3.

FIG. 1 is a block diagram of a compressor in a first embodiment of the present invention. A compressor 1 has a scroll compressor main body 2 to compress air, a motor 3 to drive the compressor main body, a control circuit 4 to control the entire compressor 1, an air tank 5 holding air compressed with the compressor main body 2, a pressure sensor 6 to detect pressure of the air tank 5, a temperature sensor (ambient air) 7 to detect ambient temperature of the compressor 1, a temperature sensor (main body) 8 to detect surface temperature of the compressor main body 2, a memory circuit 9 to store data such as set values, and an indicator 10 to notify maintenance implementation time.

Note that in the present embodiment, the compressor main body 2 is a scroll compressor. The type of the compressor main body is not limited to the scroll compressor but may be any type. Further, the pressure sensor 6 detects the pressure of the air tank 5. The detection position may be any position as long as it is on an air circuit in the compressor 1 on the output side of the compressor main body 2, or may be a position where the air tank 5 is not provided.

The control circuit 4 uses detection pressure detected with the pressure sensor 6. When the fluid pressure in the air tank 5 is lowered to lower limit pressure, the control circuit drives the motor 3. When the pressure rises to upper limit pressure, the control circuit stops the motor 3. Thus the control circuit maintains the pressure in the air tank 5 between the upper limit pressure and the lower limit pressure. Further, a calculation unit (not shown) in the control circuit obtains operating time of the compressor. As described below, the operating time is corrected in correspondence with the pressure of compressed fluid and ambient temperature, and corrected operating time is obtained. Then, accumulated operating time is obtained by accumulation of the corrected operating time from the start of use of the compressor, or from the start of use after the maintenance. When the accumulated operating time becomes previously-set maintenance time, a maintenance instruction signal is outputted.

Figure 2:
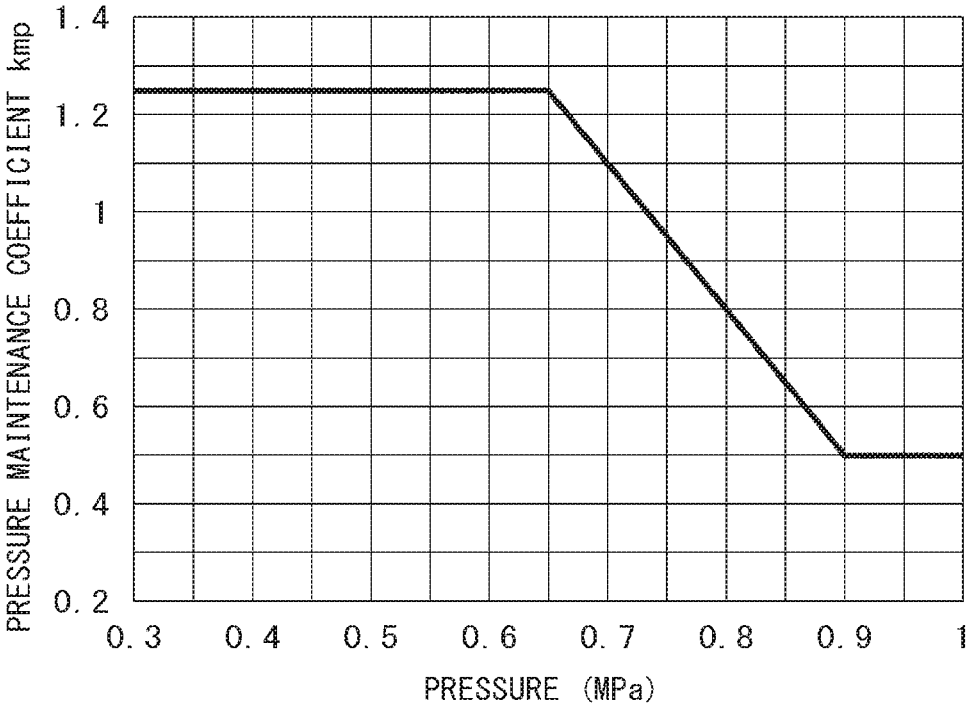
FIG. 2 is a correction map showing the relationship between pressure of compressed fluid and a pressure maintenance coefficient.

FIG. 2 is a correction map showing an example of the relationship between the pressure of the compressed fluid detected with the pressure sensor 6 and a pressure maintenance coefficient Kmp as an operating time correction coefficient. When the pressure in the tank and related pressure in the compressor main body rise, the operating condition becomes a severe condition, and abrasion and damage easily occur in the parts forming the compressor main body. Accordingly, a correction coefficient as shown in the figure is used in correspondence with pressure of the compressed fluid. The correction map in FIG. 2 is obtained by calculating degradation of bearing or grease with regard to two inflection points and graphically expressing the degradation. The correction map may be obtained by experiment.

Figure 3:
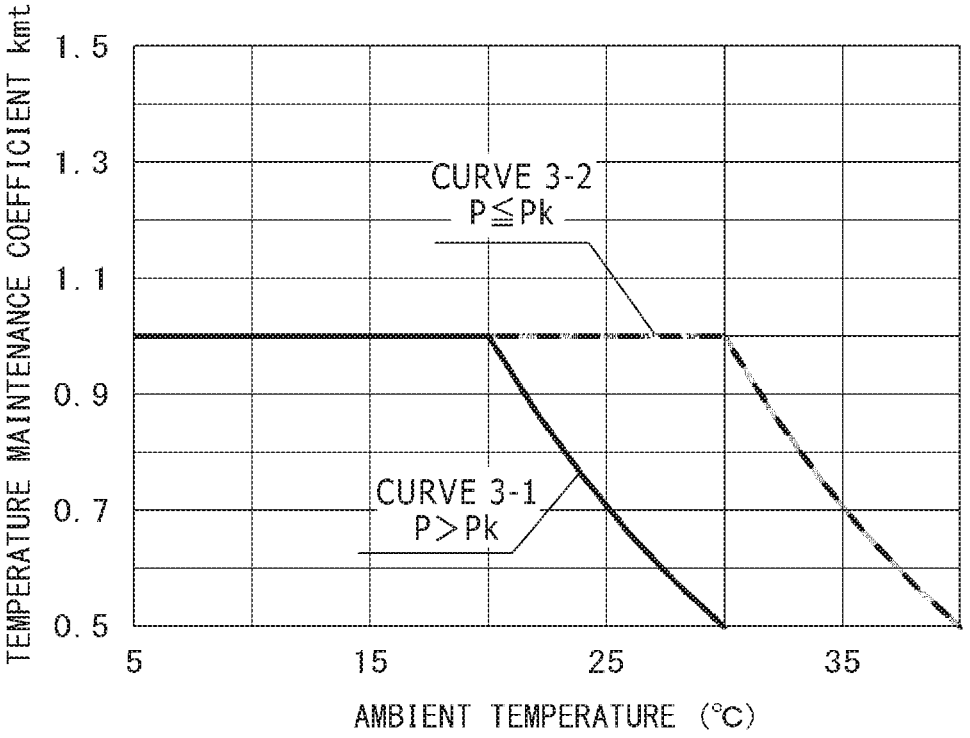
FIG. 3 is a correction map showing the relationship between ambient temperature of the compressor and a temperature maintenance coefficient in consideration of pressure.

FIG. 3 is a correction map showing an example of the relationship between the ambient temperature detected with the temperature sensor (ambient air) 7 and a temperature maintenance coefficient Kmt as an operating time correction coefficient. When the temperature of the compressor main body rises, the operating condition becomes a severe condition, and the grease, sealing or the like used in the compressor main body is easily degraded. Accordingly, a correction coefficient as shown in the figure is used in correspondence with ambient temperature. This map has a curve 3-1 used when the pressure P of the compressed fluid is higher than a threshold value Pk, and a curve 3-2 used when the pressure P of the compressed fluid is equal to or lower than the threshold value Pk. The correction map in FIG. 3 may also be obtained by calculation or may be obtained by experiment.

The correction map in FIG. 2 or FIG. 3 may be stored as a table in the memory circuit 9, or may be stored as a calculation expression in the memory circuit 9.

As an operation according to the present embodiment, the pressure maintenance coefficient Kmp is calculated with the control circuit 4 using the correction map in FIG. 2 from a detection value from the pressure sensor 6. Similarly, the temperature maintenance coefficient Kmt is calculated with the control circuit 4 using the correction map in FIG. 3 from a detection value from the temperature sensor (ambient air) 7. When the temperature maintenance coefficient Kmt is obtained, the inflection point of the temperature maintenance coefficient Kmt is changed in consideration of the internal pressure of the compressor main body. When the detection value P from the pressure sensor 6 exceeds the threshold value Pk, the curve 3-1 is used. When the detection value is equal to or lower than the threshold value Pk, the curve 3-2 is used. These correction coefficients are calculated based on the table or calculation expression of the correction map stored in the memory circuit 9.

The calculation unit (not shown) in the control circuit 4 obtains corrected operating time Tm, with the following Expression 1, from the calculated pressure maintenance coefficient Kmp, the temperature maintenance coefficient Kmt, and operating time T of the compressor main body 2.

$$Tm = T \times 1/(Kmp \times Kmt) \quad \text{(Expression 1)}$$

The accumulated operating time is obtained with the integrated value of the corrected operating time Tm from the start of use of the compressor, or from the start of use after the maintenance. When the accumulated operating time becomes previously-set maintenance time, the maintenance instruction signal is outputted.

The indicator 10 displays the accumulated operating time obtained with the control circuit 4. Further, it notifies the user of the maintenance time in correspondence with the maintenance instruction signal.

In FIG. 2, the value of the pressure maintenance coefficient Kmp corresponding to the pressure of the compressed fluid is large in a low pressure region. The value is reduced along with the rise of the pressure from the inflection point. The coefficient value becomes small in a high pressure region. Accordingly, from Expression 1, when the pressure is high, correction is made to increase the operating time. Further, when the pressure is low, correction is made to reduce the operating time. Accordingly, in a high-pressure operating state where the constituent parts of the compressor main body are seriously degraded, the maintenance time is shortened. In a low-pressure operating state where the degradation of the constituent parts of the compressor main body is not so serious, the maintenance time is extended.

In FIG. 3, the value of the temperature maintenance coefficient Kmt corresponding to the ambient temperature is large (1.0) in a low ambient temperature region, and the value is lowered along with rise of the temperature from the inflection point. Further, the inflection point differs in correspondence with pressure. When the pressure is higher than the threshold value Pk, the curve 3-1 where the pressure is lowered at a low temperature is used. When the pressure is equal to or lower than the threshold value Pk, the curve 3-2 where the pressure is lowered at a high temperature is used. Accordingly, from Expression 1, when the ambient temperature is high, correction is made to increase the operating time. When the pressure is high, correction is made to increase the operating time from a lower ambient temperature. Accordingly, in a high-temperature operating state where the constituent parts of the compressor main body are seriously degraded, the maintenance time is shortened. In the case of high pressure where the internal temperature of the compressor main body rises, correction is made to further shorten the maintenance time. Since the ambient temperature of the compressor is different from the internal temperature, it is possible to obtain maintenance time corresponding to actual internal temperature by selecting the correction coefficient in correspondence with pressure.

The selection between the curve 3-1 and the curve 3-2 in FIG. 3 is changing of temperature weighting. That is, when the pressure is higher than the threshold value Pk, the temperature weighting is increased. When the pressure is equal to or lower than the threshold value Pk, the temperature weighting is reduced.

Note that in the correction map in FIG. 3, the pressure region is divided into two regions with the threshold value Pk. When the pressure region is divided into three or more pressure regions and corresponding correction curves are set, it is possible to more accurately obtain maintenance time.

Further, in the present embodiment, although the temperature sensor (ambient air) 7 is used for temperature detection, the temperature sensor (main body) 8 may be used. The temperature sensor (main body) 8 is provided on the surface or the like of the compressor main body. It is also impossible with this sensor to detect the internal temperature of the compressor main body.

Further, in the present embodiment, although the one compressor main body 2 is used, it may be configured such that plural compressor main bodies are provided and operation-controlled.

According to the present embodiment, the corrected operating time is obtained by changing the temperature weighting in correspondence with the pressure of compressed fluid, to calculate maintenance time. Accordingly, it is possible to obtain accurate maintenance time. When the compressor is used under a high load condition, the maintenance time is shortened. It is possible to infallibly prevent failure. When the compressor is used under a low load condition, the maintenance time is extended. The time before the implementation of maintenance is extended, and customer benefits are provided.

Second Embodiment

The system according to the present embodiment will be described using FIG. 4 and FIG. 5. The elements the same as those in the first embodiment will have the same reference numerals, and explanations of these elements will be omitted.

Figure 4:
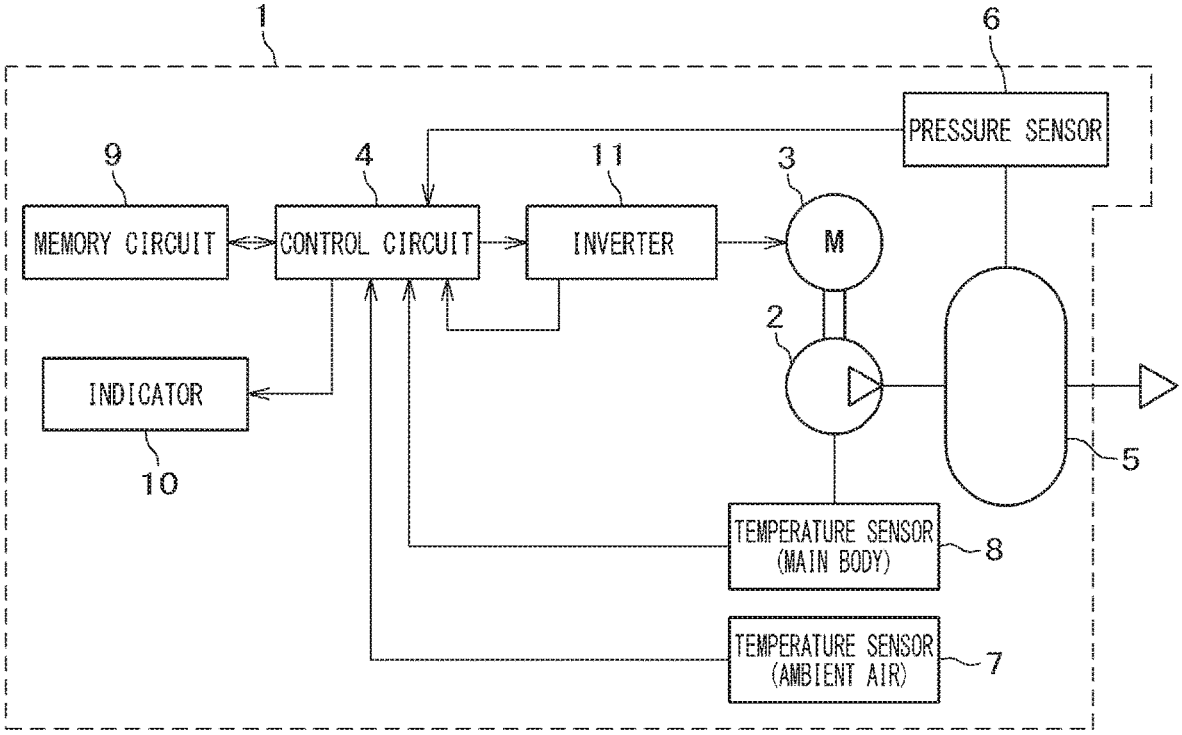
FIG. 4 is a block diagram of the compressor according to a second embodiment of the present invention.

FIG. 4 is a block diagram of the compressor according to the present embodiment. The change from the first embodiment is that an inverter circuit 11 to control the rotation speed of the motor 3 is provided.

The inverter circuit 11 performs inverter control on the rotation speed of the motor 3 such that the pressure in the air tank 5 detected with the pressure sensor 6 becomes constant.

Figure 5:
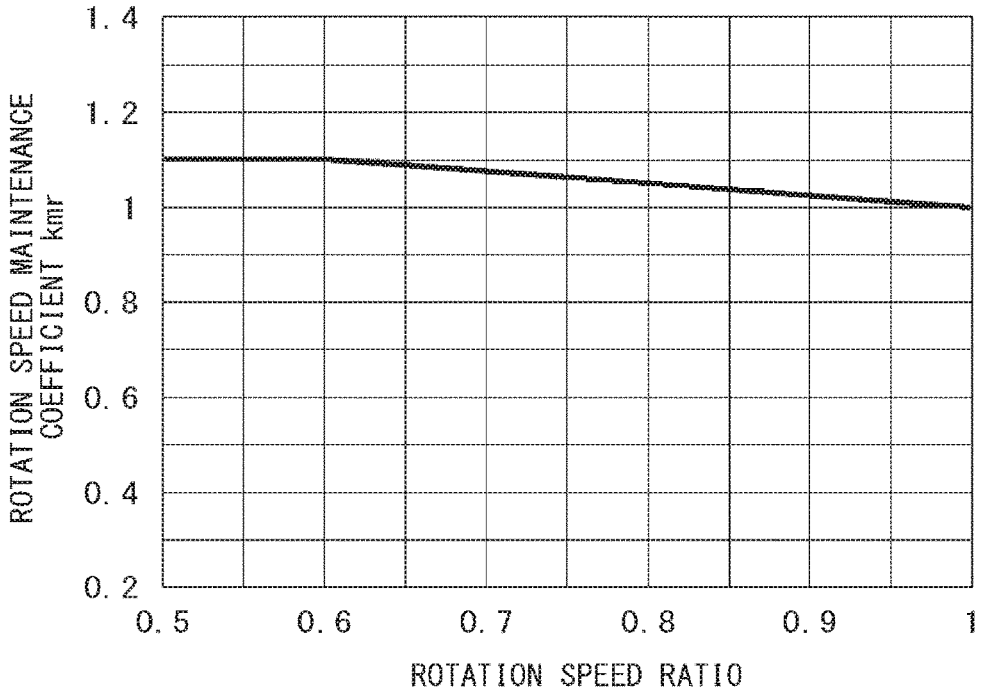
FIG. 5 is a correction map showing the relationship between rotation speed ratio of the compressor and a rotation speed maintenance coefficient.

FIG. 5 is a correction map showing an example of the relationship between the rotation speed ratio and a rotation speed maintenance coefficient Kmr as an operating time correction coefficient. The rotation speed ratio is a ratio of the motor rotation speed detected with the inverter circuit 11 with respect to a maximum rotation speed. When the rotation speed is low, the degradation of the bearing or the like is not serious. Accordingly, the rotation speed maintenance coefficient becomes larger in accordance with reduction of the rotation speed ratio.

As the operation according to the present embodiment, as in the case of the first embodiment, the control circuit 4 calculates the pressure maintenance coefficient Kmp and the temperature maintenance coefficient Kmt. Further, the control circuit calculates the rotation speed maintenance coefficient Kmr, from the motor rotation speed detected with the inverter circuit 11, based on the table or calculation expression of the correction map shown in FIG. 5 stored in the memory circuit 9.

The calculation unit (not shown) in the control circuit obtains the corrected operating time Tm with the following Expression 2, from the pressure maintenance coefficient Kmp, the temperature maintenance coefficient Kmt, the rotation speed maintenance coefficient Kmr calculated with the control circuit 4, and the operating time T of the compressor main body 2.

$$Tm = T \times 1/(Kmp \times Kmt \times Kmr) \quad \text{(Expression 2)}$$

As in the case of the first embodiment, the accumulated operating time is obtained with the integrated value of the corrected operating time Tm from the start of use of the compressor, or from the start of use after the maintenance. When the accumulated operating time becomes previously-set maintenance time, the maintenance instruction signal is outputted.

The indicator 10 displays the accumulated operating time obtained with the control circuit 4, and further, notifies a user of the maintenance time in correspondence with the maintenance instruction signal.

In the inverter-controlled compressor, the number of revolutions of the motor 3 is inverter-controlled such that the pressure in the air tank 5 becomes constant. It may be configured such that pressure setting means is provided so as to change set pressure.

According to the present embodiment, in addition to the effect of the first embodiment, it is possible in an inverter-equipped variable speed compressor to calculate accurate maintenance time in consideration of load change in accordance with change of compressor rotation speed.

Third Embodiment

In the present embodiment, in the compressor according to the first embodiment or the second embodiment, the user is notified of maintenance time without using the indicator 10.

The control circuit 4 controls the motor 3 with the maintenance instruction signal issued from the control circuit 4, to lower the upper limit pressure of the compressor 1 or the rotation speed of the compressor main body 2. Thus the performance of the product is lowered so as to notify the user of maintenance time. Alternatively, it may be configured such that the compressor main body 2 is stopped in accordance with the maintenance instruction signal.

According to the present embodiment, it is possible to omit the indicator 10 to notify maintenance implementation time described in the first embodiment.

Fourth Embodiment

The system according to the present embodiment will be described using FIG. 6 and FIG. 7.

In the present embodiment, temperature weighting is changed based on an operation rate $R_0$ of the compressor main body.

Figure 6:
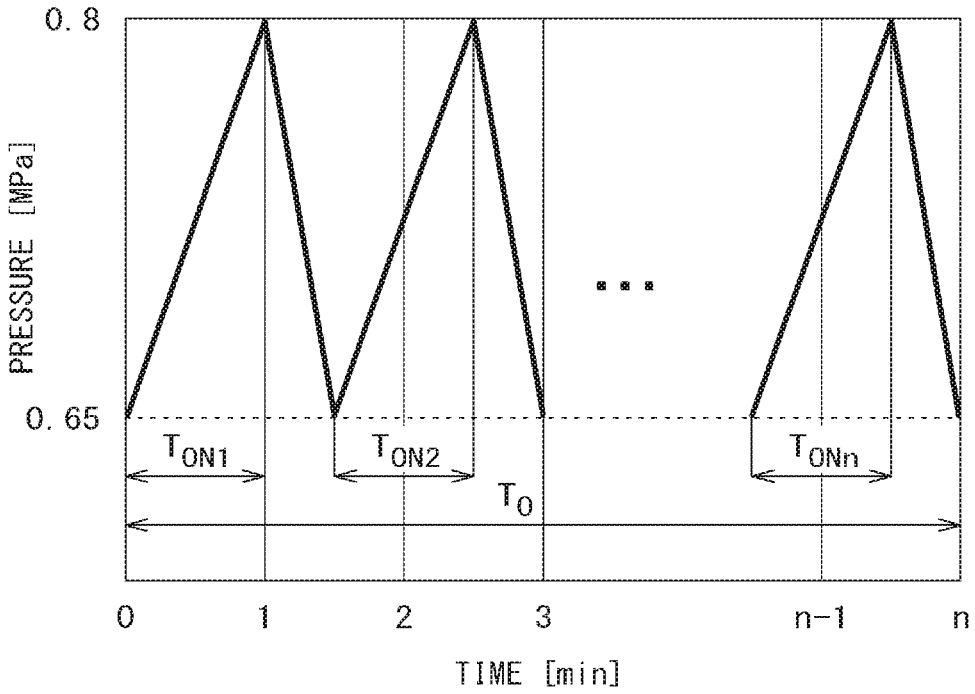
FIG. 6 is a diagram showing activation and stoppage of the compressor.

FIG. 6 is a diagram showing a driving status when the compressor is ON-OFF driven. When the compressor is driven for a period $T_{ON1}$, the fluid pressure gradually rises. When the pressure becomes the upper limit pressure, the compressor is stopped, and the fluid pressure is gradually lowered. When the pressure becomes the lower limit pressure, the compressor is again driven for a period $T_{ON2}$. This operation of the compressor is repeated. A value obtained by dividing the total sum of the operating time $T_{ON}1$ to $T_{ON}n$ of the compressor main body 2 by the entire time $T_0$ is defined as the operation rate $R_0$ of the compressor main body 2 (Expression 3).

(Expression 3)

$$R_o \equiv \frac{\sum_{i}^{m} T_{ON_s}}{T_s} \qquad \text{(Expression 3)}$$

Figure 7:
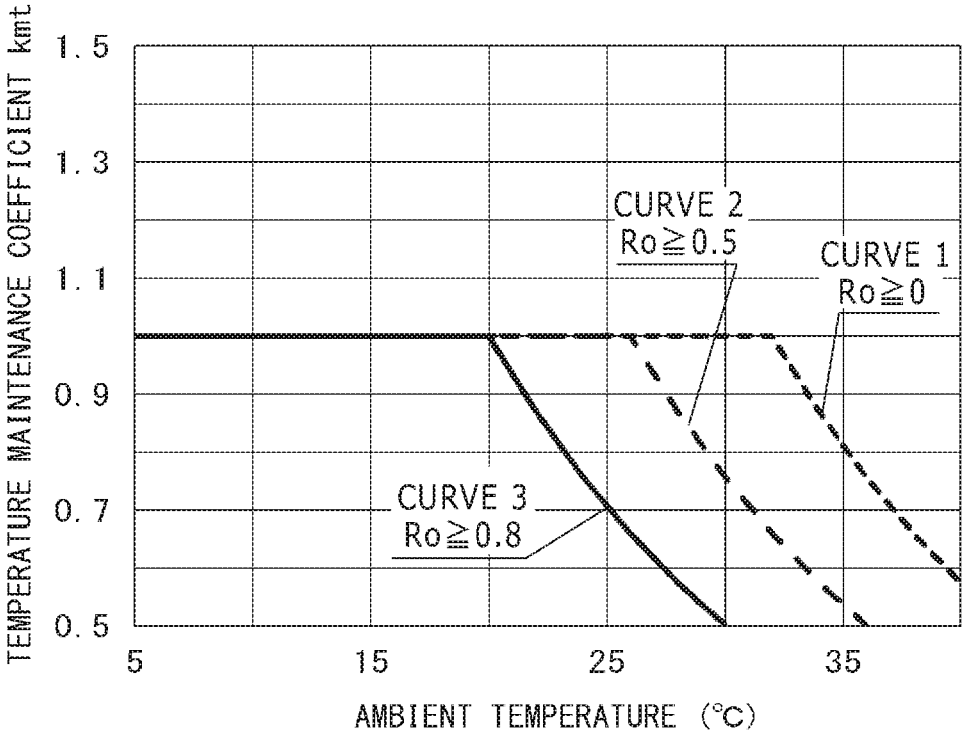
FIG. 7 is a correction map showing the relationship between the ambient temperature of the compressor and the temperature maintenance coefficient in consideration of operating rate.

FIG. 7 is a correction map showing an example of the relationship between the ambient temperature detected with the temperature sensor and the temperature maintenance coefficient Kmt as the operating time correction coefficient. When the temperature of the compressor main body rises, the operating condition becomes a severe condition, and the grease, sealing or the like used in the compressor main body is easily degraded. Accordingly, a correction coefficient as shown in the figure is used in correspondence with ambient temperature. Further, this map has a curve 3 used when the operation rate $R_0$ is equal to or higher than 0.8, a curve 2 used when the operation rate $R_0$ is equal to or higher than 0.5, and a curve 1 used when the operation rate $R_0$ is lower than 0.5. The correction map in FIG. 7 may also be previously obtained by calculation or may be obtained by experiment.

The correction map in FIG. 7 may be previously stored as a table in the memory circuit 9 or may be stored as a calculation expression in the memory circuit 9.

As the operation according to the present embodiment, first, in the block diagram of the compressor according to the first embodiment, the control circuit 4 calculates the operation rate $R_0$ of the compressor main body 2. The control circuit selects one of the curves 1 to 3 having different inflection points of the temperature maintenance coefficient shown in FIG. 7, and obtains the temperature maintenance coefficient Kmt corresponding to the ambient temperature, in correspondence with the value of the calculated operation rate $R_0$.

As in the case of the first embodiment, from the calculated temperature maintenance coefficient Kmt, the pressure maintenance coefficient Kmp, and the operating time T, the corrected operating time Tm is calculated based on Expression 1. The accumulated operating time is obtained with the integrated value of the corrected operating time Tm from the start of use of the compressor, or from the start of use after the maintenance. When the accumulated operating time becomes previously-set maintenance time, the maintenance instruction signal is outputted.

The indicator 10 displays the accumulated operating time obtained with the control circuit 4, and notifies the user of the maintenance time in correspondence with the maintenance instruction signal.

In FIG. 7, the value of the temperature maintenance coefficient Kmt corresponding to the ambient temperature is large (1.0) in a low ambient temperature region. It is lowered in accordance with temperature rise from the inflection point. Further, the inflection point differs in correspondence with the operation rate $R_0$. When the operation rate is high, the curve 3 when it is lowered from a low temperature is used. When the operation rate is low, the curve 1 when it is lowered at high temperature is used. Accordingly, from Expression 1, when the ambient temperature is high, correction is made so as to increase the operating time, and when the operation rate is high, correction is made so as to increase the operating time from lower ambient temperature. Accordingly, in a high-temperature operating state where the constituent parts of the compressor main body are seriously degraded, the maintenance time is short. In a case where the operation rate is high when the internal temperature of the compressor main body rises, correction is made so as to further reduce the maintenance time. Since the ambient temperature of the compressor is different from the internal temperature, it is possible to obtain maintenance time corresponding to actual internal temperature by selecting the correction coefficient in correspondence with operation rate.

The selection of the curves 1 to 3 in FIG. 7 is changing of temperature weighting. When the operation rate is high, the temperature weighting is increased. When the operation rate is low, the temperature weighting is reduced.

In the present embodiment, in addition to the effect of the first embodiment, since maintenance implementation time, including the operation rate $R_0$ which influences the life of the compressor main body 2, is changed, it is possible to calculate accurate maintenance time.

Fifth Embodiment

In the present embodiment, in the compressor according to the first embodiment or the second embodiment, remaining time before maintenance implementation is estimated and notified to the user.

In the control circuit 4, it is possible to obtain the remaining time before maintenance implementation by subtracting the accumulated operating time obtained in the first embodiment or the like from the previously-set maintenance time. The obtained remaining time is displayed on the indicator 10.

According to the present embodiment, since the remaining time before maintenance implementation is displayed, it is possible to know the remaining operating time and to improve operability for the user.

REFERENCE SIGNS LIST

1: compressor
2: compressor main body
3: motor
4: control circuit
5: air tank
6: pressure sensor
7: temperature sensor (ambient air)
8: temperature sensor (compressor main body)
9: memory circuit
10: indicator
11: inverter circuit

The invention claimed is:

1. A compressor comprising:

a compressor main body that compresses fluid;

a motor that drives the compressor main body;

a temperature sensor that detects temperature of the compressor;

a pressure sensor that detects pressure of compressed fluid outputted from the compressor main body; and a calculation unit that calculates a maintenance cycle of the compressor main body using the temperature of the compressor and the pressure of the compressed fluid, wherein the temperature and the pressure have respective weights.

2. The compressor according to claim 1, wherein the calculation unit changes weighting of the temperature in correspondence with the pressure of the compressed fluid.

3. The compressor according to claim 2, wherein when the pressure of the compressed fluid is high, the calculation unit increases the weighting of the temperature, while when the pressure of the compressed fluid is low, the calculation unit reduces the weighting of the temperature.

4. The compressor according to claim 1, further comprising a display mechanism that displays accumulated operating time calculated with the calculation unit.

5. The compressor according to claim 1, wherein the calculation unit calculates time before implementation of maintenance of the compressor main body, and wherein the compressor further comprises a display mechanism that displays the time before implementation of the maintenance.

6. The compressor according to claim 1, wherein at maintenance implementation time calculated with the calculation unit, the compressor main body is stopped.

7. The compressor according to claim 1, wherein the calculation unit changes the maintenance cycle in correspondence with rotation speed of the motor.

8. The compressor according to claim 7, further comprising an inverter circuit, wherein the motor is inverter-controlled based on the pressure detected with the pressure sensor.

9. The compressor according to claim 1, wherein at maintenance implementation time calculated with the calculation unit, the rotation speed of the motor is reduced.

10. The compressor according to claim 1, wherein at maintenance implementation time calculated with the calculation unit, target pressure of the compressed fluid is lowered and the compressor main body is operated.

11. The compressor according to claim 1, wherein the calculation unit changes the weighting of the temperature in correspondence with operation rate of the compressor main body.

12. The compressor according to claim 11, wherein when the operation rate of the compressor main body is high, the calculation unit increases the weighting of the temperature, while when the operation rate of the compressor main body is low, the calculation unit reduces the weighting of the temperature.

13. The compressor according to claim 1, further comprising pressure setting means for the compressed fluid to change set pressure with the pressure setting means.

* * * * *